US005614887A

United States Patent [19]

Buchbinder

[11] Patent Number: 5,614,887

[45] Date of Patent: Mar. 25, 1997

[54] PATIENT MONITORING SYSTEM AND METHOD THEREOF

[76] Inventor: Dale Buchbinder, 12306 Michaelsford Rd., Cockeysville, Md. 21030

[21] Appl. No.: 487,855

[22] Filed: Jun. 7, 1995

[51] Int. Cl.[6] ..... G08B 21/00

[52] U.S. Cl. ..... 340/573; 128/630; 128/739; 128/741; 128/742; 340/575; 340/576

[58] Field of Search ..... 340/573, 576, 340/575; 128/739, 741, 742, 630

[56] References Cited

U.S. PATENT DOCUMENTS

| | | | |
|---|---|---|---|
| 3,818,448 | 6/1974 | Wilkins | 340/825.19 |
| 3,911,416 | 10/1975 | Feder | 340/825.46 |
| 3,929,335 | 12/1975 | Malick | 340/573 |
| 4,196,412 | 4/1980 | Sluis et al. | 340/576 |
| 4,275,383 | 6/1981 | White et al. | 340/286.07 |
| 4,298,863 | 11/1981 | Natitus et al. | 340/577 |
| 4,408,192 | 10/1983 | Ward et al. | 340/407.1 |
| 4,553,138 | 11/1985 | Nakanishi et al. | 340/584 |
| 4,731,603 | 3/1988 | McRae et al. | 340/407.1 |
| 4,810,996 | 3/1989 | Glen et al. | 340/321 |
| 4,853,674 | 8/1989 | Kiss | 340/407.1 |
| 5,012,226 | 4/1991 | Love | 340/576 |
| 5,259,390 | 11/1993 | MacLean | 128/739 |
| 5,319,355 | 6/1994 | Russek | 340/573 |

*Primary Examiner*—Glen Swann
*Attorney, Agent, or Firm*—Kalish & Gilster

[57] ABSTRACT

A patient monitoring system and method include a neuro-sensory motor stimulator which is applied to a patient. A resetting device and a stimulating device are in contact with the patient, and upon activating the resetting device, the stimulating device is turned off. If the monitored patient fails to timely activate the resetting device, an alarm sounds to alert medical personnel that the patient is in need of attention. The method provides for setting a first timer which controls stimulations and setting a second timer which controls the time period between stimulations and sounding of an alarm.

19 Claims, 5 Drawing Sheets

PATIENT MONITORING SYSTEM AND METHOD THEREOF

BACKGROUND OF THE INVENTION

This invention relates generally to the art of medical electronics, and more particularly to a patient monitoring system that utilizes a neuro-sensory motor stimulator.

During certain types of medical procedures, it is necessary to determine whether the patient is awake and responsive. For example, when a carotid endarterectomy is performed on a patient, it is necessary to monitor brain function as determined by response to a tactile response to demonstrate both sensory and motor function. The present invention provides a non-invasive, mechanical system for monitoring such a patient, which device sounds an alarm to notify medical personnel when the patient fails to respond.

The problem with current patient monitoring systems is that they do not permit noninvasive monitoring of both sensory and motor function in awake patients to determine if they can move the appropriate extremity following tactile stimulation. Such functionality is essential to monitor brain function and may be used during the performance of carotid endarterectomy on awake patients. Such functionality also permits the system to monitor neurological functions in patients with the possibility of a neurological deficit, or to determine the level of motor function following administration neuroleptic agents.

One proven method of monitoring a patient's vital signs by using a mechanical system is disclosed in U.S. Pat. No. 5,319,355, which issued to Russek ("the Russek method"). Under this method, a life support equipment monitor is connected to an alarm signal pulse generator. The signal is transmitted to a master control unit which then transmits an alarm to pagers to notify medical personnel of the monitored patient's need for assistance. The Russek method, however, does not stimulate or alarm the monitored patient.

Additional procedures are disclosed in U.S. Pat. Nos. 4,275,383 and 4,298,863 wherein each provides a procedure for distressed patients to call and alert medical personnel. None of these references provide a patient monitor wherein the patient being monitored responds to a tactile signal, and is thereby medically "observed" and stimulated as necessary.

SUMMARY OF THE INVENTION

The novel system of the invention may be used in the operating room, critical care units, emergency room, or any area in the hospital or any vehicle being used to transport patients equipped with a suitable power supply. The unit may be used during carotid endarterectomy under regional and/or local anesthesia. An alarm will sound if the patient does not respond to the stimulation, thus alerting the surgeon that the patient may be losing neurologic function, and that an intravascular shunt may need to be rapidly placed to avoid permanent neurologic damage. This novel system may also alert nurses and other health care providers that a patient may be losing neurologic function, which would require rapid intervention. Monitoring these patients can be accomplished by the device of this invention instead of examinations by physicians, nurses or other health care providers, and this monitoring can be repeated at any time interval desired.

Thus, it is among the several goals of the present invention to provide a patient monitoring system that incorporates a neuro-sensory stimulator to monitor unconscious or semi-conscious medical patients, which system utilizes communication with the monitored patient's neuro-muscular systems to gently and effectively stimulate a patient response. It is further among the goals of the present invention that such patient monitoring system be operated in a safe, relatively painless and economical manner, that it be highly automated and facile to operate, thus reducing the need for expensive and prolonged training of medical personnel.

It is also among the goals of the present invention, having the features indicated, that the patient monitoring system using a neuro-sensory stimulator be suitable for use on either or both of a patient's hands and feet, or even on all extremities simultaneously.

It is further among the goals of the present invention that the patient monitoring system have the capability of being applied to all parts of the body by tape, Velcro fasteners and the like.

The patient will be provided with a monitoring system that causes tactile sensory stimulation resulting in an appropriate motor response. The patient's response will cause the stimulation to stop, reset a timer mechanism, and turn off an alarm. The process can be cycled, with the interval of cycle adjusted to any predetermined duration. The monitoring system will deliver a sensory stimulus by vibration, temperature change, air-flow or any other method that will produce tactile stimulation. The patient may press a button with either hand or either foot or cause a response by finger movement. The completion of this responsive motor activity will terminate the stimulation, recycle the timer, and turn off the alarm. This cycle will be repeated at any interval set by the operator. The monitoring system can be used on either side of the body, either extremity or on all extremities simultaneously, or any combination or placed on any part of the patient's body. The monitoring system will allow consistent observation without a physician or nurse performing an examination and the response cycle can be adjusted to allow more or less neuro-sensory motor stimulations.

The new patient monitoring system will preferably be battery operated; however, a model that can plug into a conventional wall monitor or bed-side monitor is also acceptable. The monitoring system will consist generally of a basic unit in which there will be a hand or foot device which can either be held by or attached to a patient. The stimulator will vibrate or produce other forms of tactile sensory stimulation. There is further provided a button or foot switch which will be activated causing the stimulation to stop and recycle the event timer. If the patient fails to press the button, an alarm will continue to sound notifying the health care provider (observer) that the patient is not responding to the stimulation and there may be a neurologic problem that requires immediate attention. An illustrative patient monitoring system consists of a handle held by the patient, a vibrating motor and a button on the handle. The motor will vibrate at a predetermined interval that can be set by a recycling timer. In use, the system will vibrate, and typically, the patient will press the button and vibration will stop. If, however, the button is not pressed, the alarm will sound thereby alerting the attending health care provider that there may be a problem with the patient.

The present invention also provides a method for monitoring a patient by a system which includes a neuro-sensory motor stimulator and an alarm. The method is characterized by setting a first timer which controls stimulations to a patient and setting a second timer which controls the time period between stimulation and sounding of an alarm.

Accordingly, in furtherance of the above goals, the present invention is, briefly, a patient monitoring system which includes a neuro-sensory motor stimulator and an alarm. A first timer is in connection with the stimulator, a second timer is in connection with the alarm, and a resetting device is in connection with the first and second timers. A power supply is provided, so that the stimulator, in contact with a patient, can be activated by the first timer. The stimulator is deactivated and the first timer is reset by the patient by activation of the resetting device. The alarm is, however, initiated after a predetermined time according to the second timer if the first timer is not reset by the resetting device, thereby notifying a health care provider that the patient has not responded to the neuro-sensory stimulator. After initiation, the alarm is turned off and the second timer is reset by activating the resetting device.

The present invention may also incorporate the alarm and resetting device into a single unit. The alarm will sound when the stimulation begins or with a short delay and will stop when the patient presses a button or pedal.

Other goals and advantages of the present invention will be in part apparent and in part pointed out hereinbelow.

BRIEF DESCRIPTION OF THE DRAWINGS

Throughout the drawings, like parts are indicated by like element numbers.

DESCRIPTION OF PREFERRED EMBODIMENTS

Figure 1:
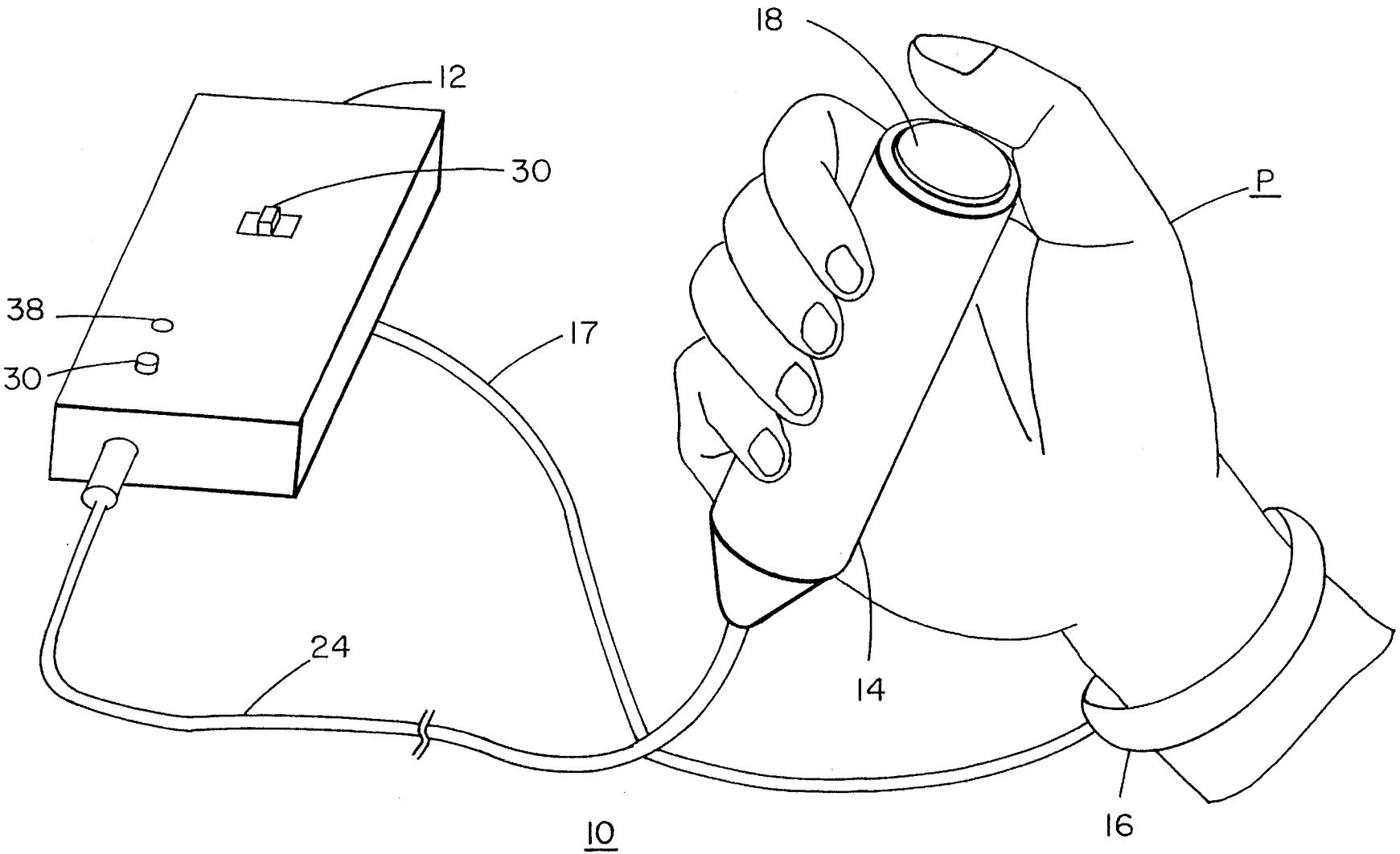
FIG. 1 is a fragmentary perspective view of a patient monitoring system according to the present invention showing one example of use.
Figure 1A:
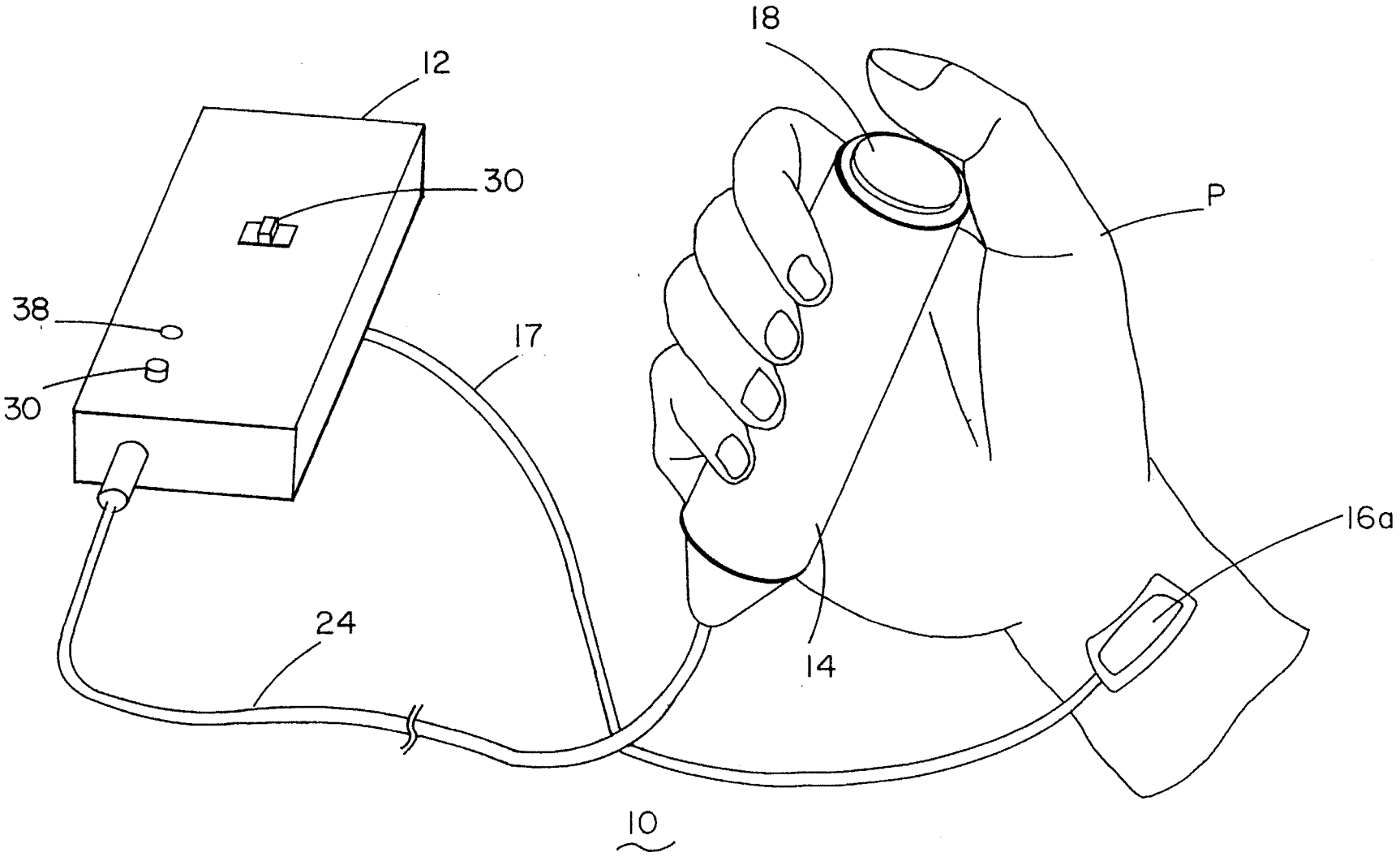
FIG. 1A is a fragmentary perspective view of an alternative embodiment of the patient monitoring system of FIG. 1.
Figure 2:
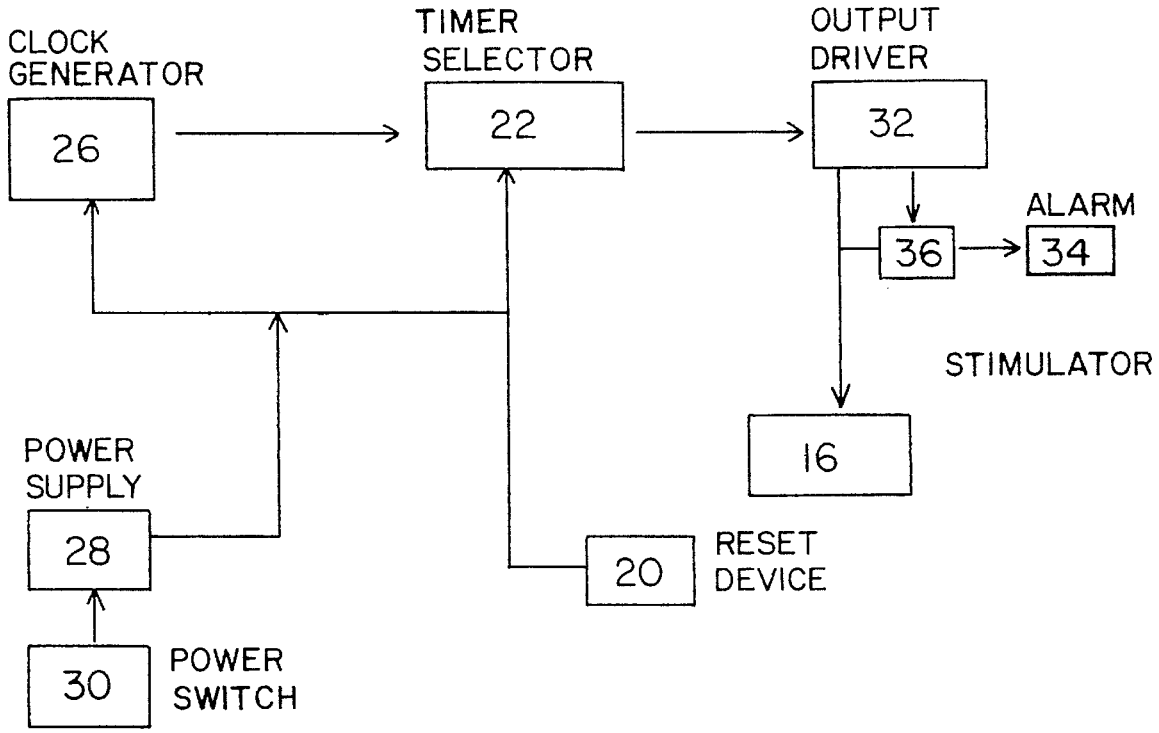
FIG. 2 is a block diagram showing the basic operation of the patient monitoring system of FIG. 1.
Figure 3:
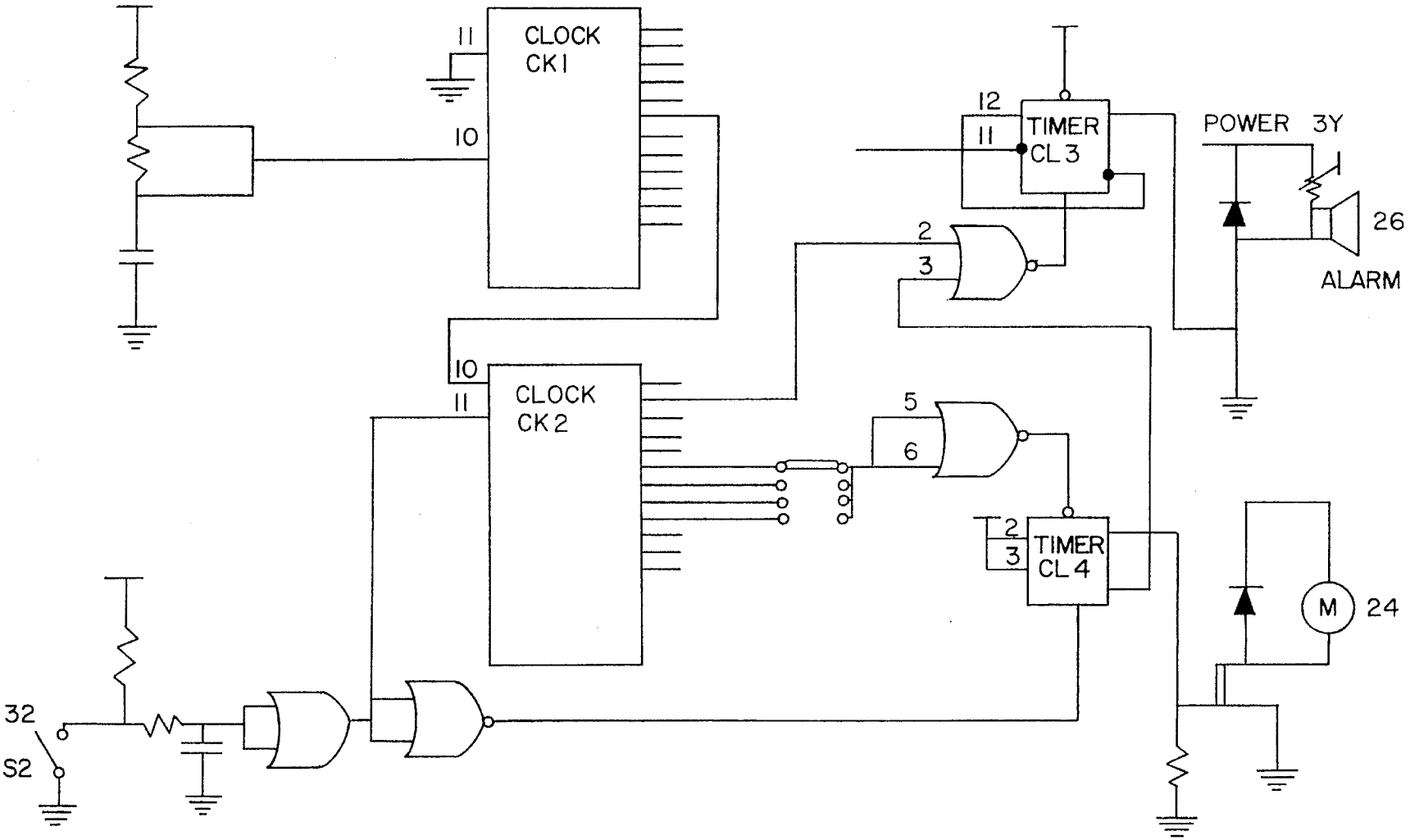
FIG. 3 is a typical schematic circuit diagram of an embodiment of the patient monitoring system of FIG. 1.

FIG. 1 shows a patient monitoring system 10 according to the present invention. System 10 preferably comprises a controller 12 and a stimulation response device 14 and a stimulator 16 connected thereto. Stimulation response device 14 is preferably placed proximate the patient so that it can be comfortably and conveniently reached by the patient. Preferably, stimulation response device 14 is of a shape such as cylindrical, for example, which allows it to be hand-held and is made of a dielectric material, such as polyacrylate, polycarbonate or polyester. Alternatively, stimulation response device 14 is in the form of a pedal for foot operation. Stimulation response device 14 further comprises a reset button 18 which, when depressed, controls the operation of stimulator 16. When reset button 18 is depressed, a reset device 20 (as shown in FIG. 2), located within the stimulation activation device 14 is activated, which resets timer selector 22. Reset device 20 deactivates the stimulation response device 14, and resets the first timer CL4 (FIG. 3). Stimulator 16 is connected to controller 12 by a flexible cable 17.

A simplified assembly of stimulation response device 14 and stimulator 16 consists of both elements being contained in a single unitary system. Thus, stimulator 16 would typically be attached to the hand-held unit that is represented by stimulation response device 14 as illustrated and shown in FIG. 1. Throughout the description of this invention it should be understood that elements 14 and 16 can be separate and distinct elements (i.e., detachable from controller 12) or be combined into a single unitary system as exemplified by the hand-held unit shown in FIG. 1. Also, the stimulator may take the form of an adhesive patch **16*a*, connected by cable 17 to controller 12, as indicated in phantom in FIG. 1**A.

As shown in FIG. 2, reset device 20 activates timer selector 22, which is housed in controller 12. Controller 12 is made of suitable materials such as metal, e.g., stainless steel, a dielectric material, e.g., polyacrylate, polycarbonate, polyester, or wood. Reset device 20 is connected to timer selector 22 by a flexible cable 24. Connected to timer selector 22 is a clock generator 26, which is housed in controller 12. Connected to clock generator 26 is a power supply 28 (also indicated in FIG. 4) which is also housed in controller 12. A power activation switch 30, is attached to the power supply and desirably located on the exterior surface of controller 12 for providing power to operate patient stimulation system 10.

Timer selector 22 is connected to an output driver 32, which is in turn connected to stimulator 16 and alarm 34. Stimulator 16 may include such forms of stimulation as a vibrator, an audio alarm, a heater, compressed air, or other mechanical devices that will alert a patient P to reset the patient monitoring system 10 by depressing reset button 18. Preferably, stimulator 16 is a vibrating device. Stimulator 16 can be a separate unit from reset device 20, as shown in FIG. 1, or may be incorporated into the same body, as for example stimulator activation device 14 having contained therein reset button 18. When patient P presses reset button 18, timer selector 22 is reset, causing the timer selector to deactivate stimulator 16. After passage of a predetermined time period, stimulator 16 is reactivated by timer selector 22, causing stimulation of the patient resulting in a patient response, thus causing the patient to press reset button 18.

Alarm 34 can transmit an audible or visual signal such as a buzzer, siren, or flashing light, or a combination audible-visual signal. The alarm is activated when a patient fails to respond to stimulator 16 by pressing reset button 18 within a predetermined time period. Alarm 34 can be deactivated by a control switch 36. Alarm 34 can be a separate unit, independently connected to clock generator 26, or it can be located within controller 12. With the other components of the patient monitor system, as shown in FIG. 1. Controller 12 is further provided with an indicator, such as light 38, that is lit or otherwise indicates when the power supply, such as a battery or power pack, is providing power sufficient to operate the alarm. In this example, when light 38 is off, the power level is insufficient. By use of this feature, users, such as medical personnel, can quickly and easily determine if the monitor is operating and make any necessary adjustments to ensure no inadvertent consequences occur.

FIG. 3 shows a typical electronic circuit which can be utilized in the functioning of the patient monitoring system according to the present invention. The monitoring system includes an alarm 34 that emits an audio signal. Alarm 34 is wired to timer CL3. Stimulator 16 is a vibrator and is electrically connected to timer CL4. The clocks CK1 and CK2 can be set for predetermined periods for T1 and T2. T1 is the time period between stimulations. T2 is the time period between stimulator 16 being initiated and the alarm sounding if the reset button 18 is not activated. This time period between stimulation and sounding of the alarm is a critical feature of the invention disclosed herein. Time period T1 has a broad range of one second to 24 hours and a narrow, more preferred range of 20 seconds to two hours. Time period T2 should not exceed 5 seconds. Clocks CK1 and CK2 are attached to timers CL3 and CL4, respectively, and are reset by closing switch S2 which is reset device 20. When the reset device 20 is activated, by pressing reset button 18, stimulator 16 is turned off and timer CL4 is reset. If the patient does not press reset button 18, alarm 34 is activated after time period T2 expires. Upon the reset button 18 being pressed after the alarm is activated, the timer CL3 and CL4 are reset, and the cycle starts again.

Figure 4:
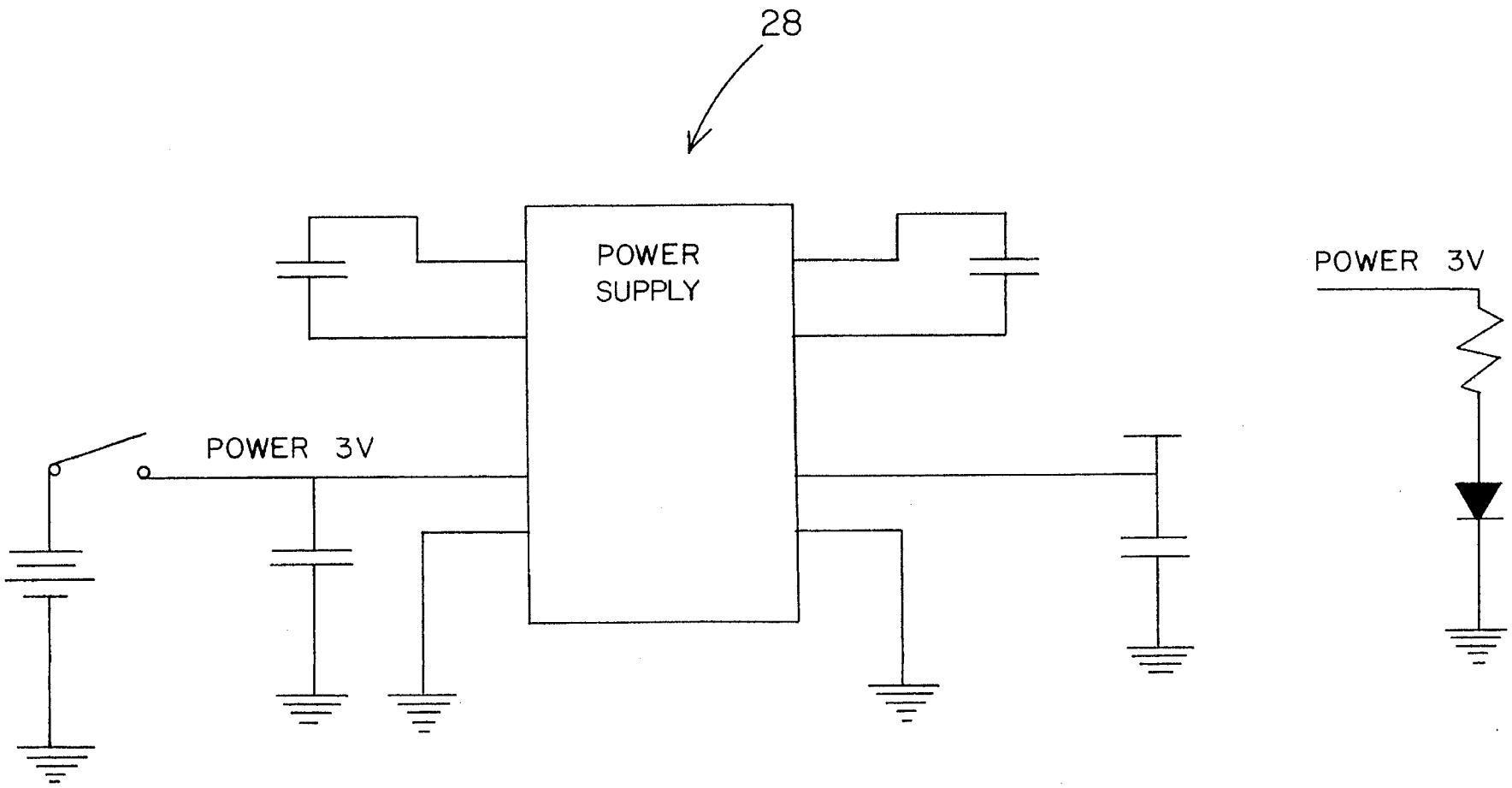
FIG. 4 is a typical schematic circuit diagram of an embodiment of a power supply for the monitoring system of FIG. 1.

FIG. 4 shows a power pack adaptable for patient monitoring system 10, suitable for the system shown in FIG. 3. The power pack desirably provides approximately 3 volts to approximately 6 volts. Other sources of power, such a 110 ampere alternating currents, are suitable for the present invention, but a power pack or 2–4 type AA batteries provide mobility and ease of use, and are preferred.

The convenience and wide ranging possible uses for the novel system disclosed and described herein, including the neuro-sensory motor stimulator of the invention, can be readily apparent in view of the above discussion. It is especially convenient in that the inventive system can be used as attached to one or both hands, one or both feet, or any combination of the above, of the monitored patient. The system may also be used in conjunction with known vital-sign monitors to further monitor neuro-sensory function in a medical patient.

Regardless of the particular combination of limbs to which the new patient monitoring system is connected to, failure of the patient to respond within the time required by the system will cause a triggering or "sounding" of the alarm.

FIG. 1 shows the patient monitoring system 10 of this invention for monitoring the neuro-sensory motor response in one extremity, namely a hand. It is within the scope of this invention to provide a pair of stimulators 16 and 16' (not shown) for monitoring the neuro-sensory motor responses in both hands. Similarly, the patient monitoring system of this invention contemplates using stimulators for monitoring the neuro-sensory motor responses of a patient's feet by locating and positioning a stimulator such as exemplified by stimulator 16 on a patient's foot or feet as desired by the attending health care provider. This example is not illustrated in the figures, however, a separate stimulator 16 for each extremity would be electrically connected to a controller 12 and would function as described herein. It is further within the scope of the patient monitoring system of this invention that a stimulator as illustrated by stimulator 16 be attached to any part of the body such as on the forehead to monitor neuro-sensory motor responses caused by a head trauma or, for example, attached to a pressure point. The stimulator may be attached by adhesive tape on Velcro fasteners. To practice this invention, a stimulator can be glued or attached to a patient's skin with a conventional EKG lead. The stimulator would be vibrated and the patient would then activate an external resetting device by hand, finger or foot. The stimulator 16 would be provided with a stimulation activation device 14 and a reset device 20 allowing the patient's neuro-sensory motor responses to be monitored. Each stimulator 16 would be connected to controller 12 by a flexible cable 17 as hereinbefore described.

Examples of representative situations in which the new patient monitoring system may be used, are as follows:

for patients undergoing carotid artery surgery, any surgery when motor-sensory response should be monitored, during any form of anesthesia where monitoring of neuro-sensory response is desirable;

for patients with head injuries that are discharged from a hospital and sent home that require monitoring for neurological functions; and to monitor neuro-sensory responses in patients in monitored bed situations, i.e., ICU, PACU, CCU, head trauma units, post operative carotid surgery, and stroke units, etc.

While a new and novel patient monitoring system has been shown and described in detail, it is to be understood that this invention is not to be considered to be limited to the exact form disclosed in that changes in detail and construction may be made therein within the scope of this invention without departing from the spirit thereof.

The system can be manufactured in any size or shape that will allow the above-mentioned functions to occur. It also can have the ability to be attached to conventional multi-functional patient monitors which will allow for feedback into station terminals or via telemetry units.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A system for observer monitoring of a patient, the system comprising:

a stimulator adapted to provide stimulation to the patient;

a stimulation response device having a button adapted to deactivate the stimulator; and a controller in communication with the stimulator and the stimulation response device, the controller comprising:

means to periodically activate the stimulator;

a stimulator timer adapted to activate when the stimulator has been activated and to reset when the stimulator is deactivated; and an observer alarm adapted to activate if the button of the stimulation response device has not been pressed by the patient within a predetermined time from the activation of the stimulator timer.

2. The patient monitoring system of claim 1, wherein the observer alarm is deactivated and the stimulator timer is reset when the patient depresses the button of the stimulation response device.

3. The patient monitoring system of claim 1, wherein the stimulation provided by the stimulator is at least one of a vibration, sound and heat.

4. The patient monitoring system of claim 1, wherein the observer alarm provided by the controller is at least one of an audible alarm and a visual alarm.

5. The patient monitoring system of claim 1, wherein the system is battery operated.

6. The patient monitoring system of claim 1, wherein the stimulation activation device is hand-held by the patient.

7. The patient monitoring system of claim 1, wherein the stimulator and the controller are provided as elements of a single unitary system.

8. The patient monitoring system of claim 1, wherein the stimulation response device and the controller are provided as elements of a single unitary system.

9. A patient monitoring system, comprising:

stimulator means applied by an adhesive patch to a patient's body for providing stimulation to a patient;

stimulation response means for controlling the operation of said stimulator means;

means for controlling the operation of said stimulation response means;

control means in communication with said stimulator means and stimulation response means, said control means comprising:

first timing means for controlling the activation of said stimulator means; and second timing means for activating an alarm means upon expiration of a predetermined period of time from said activation unless the stimulation response means has been activated by the patient, wherein the stimulation response means is at least one hand-held unit.

10. A method of an observer monitoring a patient with a patient monitoring system comprising a patient stimulator, a stimulation response device having a button adapted to control the operation of the patient stimulator, and a controller in communication with the patient stimulator and response device, the controller comprising a patient stimulator timer and an observer alarm, the method comprising the steps of:

the observer activating the stimulator timer of the controller, which controller then periodically actuates the patient stimulator; and the system activating the alarm of the controller if the button of the stimulation response device is not pressed by the patient within a predetermined time of the actuation of the patient stimulator.

11. The method of claim 10, further comprising the step of the system deactivating the observer alarm when the button of the stimulation response device is depressed by the patient.

12. The method of claim 10, wherein the stimulator timer is reset whenever the observer presses the button of the stimulation activation device.

13. The method of claim 12, further comprising the step of the patient resetting the stimulator timer.

14. The method of claim 13, wherein the step of resetting the stimulator timer comprises the step of the patient pressing the button of the stimulation response device.

15. A method of an observer monitoring a patient with a patient monitoring system, the method comprising the steps of:

providing a neuro-sensory stimulator adapted to cause a motor response in a patient;

providing a stimulation activation device for operating said neuro-sensory stimulator;

providing a device whereby a patient may control said stimulation activation device;

providing an alarm system that alerts a health care provider that the patient has failed to give such motor response;

setting a first timer to a predetermined time interval for controlling the periodic initiation of patient stimulation; and setting a second timer to a predetermined time interval from patient stimulation to sounding of the observer alarm to activate the alarm system if the patient does not reset the stimulation activation device.

16. The method of claim 15, further comprising:

the step of setting the time period of said first timer from one second to 24 hours.

17. The method of claim 16, further comprising:

the step of setting the time period of said first timer from 20 seconds to two hours.

18. The method of claim 15 further comprising:

the step of setting the time period of said second timer not to exceed 5 seconds.

19. A patient monitoring system, comprising:

stimulator means for providing stimulation to a patient;

stimulation response means for controlling the operation of said stimulator means;

means for controlling the operation of said stimulation response means;

control means in communication with said stimulator means and stimulation response means, said control means comprising:

first timing means for controlling the activation of said stimulator means; and second timing means for activating an alarm means upon expiration of a predetermined period of time from said activation unless the stimulation response means has been activated by the patient, wherein the stimulation response means is a pair of hand held units.

* * * * *